US008555671B2

(12) United States Patent
Lourenco et al.

(10) Patent No.: US 8,555,671 B2
(45) Date of Patent: Oct. 15, 2013

(54) METHOD OF CONDITIONING NATURAL GAS IN PREPARATION FOR STORAGE

(76) Inventors: Jose Lourenco, Toronto (CA); MacKenzie Millar, Edmonton (CA)

( * ) Notice: Subject to any disclaimer, the term of this patent is extended or adjusted under 35 U.S.C. 154(b) by 1376 days.

(21) Appl. No.: 12/162,988

(22) PCT Filed: Jan. 31, 2007

(86) PCT No.: PCT/CA2007/000140
§ 371 (c)(1),
(2), (4) Date: Jul. 31, 2008

(87) PCT Pub. No.: WO2007/087713
PCT Pub. Date: Aug. 9, 2007

(65) Prior Publication Data

US 2009/0019887 A1 Jan. 22, 2009

(30) Foreign Application Priority Data

Jan. 20, 2006 (CA) ..... 2536075

(51) Int. Cl.
*F25J 1/00* (2006.01)

(52) U.S. Cl.
USPC ..... 62/611; 62/618; 62/630

(58) Field of Classification Search
CPC ..... F25J 1/0022; F25J 1/0035; F25J 1/0201; F25J 3/061; F25J 3/0635
USPC ..... 62/611, 612, 613, 618, 619, 620, 621, 62/630
See application file for complete search history.

(56) References Cited

U.S. PATENT DOCUMENTS

| | | | | | |
|---|---|---|---|---|---|
| 4,869,740 | A | * | 9/1989 | Campbell et al. | 62/621 |
| 4,936,888 | A | * | 6/1990 | DeLong | 62/622 |
| 4,948,405 | A | * | 8/1990 | Thompson | 62/630 |
| 5,799,505 | A | | 9/1998 | Bonaquist | |
| 5,953,935 | A | * | 9/1999 | Sorensen | 62/621 |
| 6,138,473 | A | | 10/2000 | Boyer-Vidal | |

(Continued)

FOREIGN PATENT DOCUMENTS

| | | |
|---|---|---|
| CA | 2 515 999 A1 | 9/2004 |
| CA | 2 552 366 A1 | 7/2005 |

(Continued)

OTHER PUBLICATIONS

Supplementary European Search Report mailed Jul. 8, 2013, issued in corresponding Application No. EP 07 70 1740.8, filed Jan. 31, 2007, 2 pages.

*Primary Examiner* — Frantz Jules
*Assistant Examiner* — Alexandro Acevedo Torres
(74) *Attorney, Agent, or Firm* — Christensen O'Connor Johnson Kindness PLLC

(57) ABSTRACT

A method of conditioning natural gas in preparation for storage, involves taking an existing stream of continuously flowing natural gas flowing through a gas line (12) on its way to end users and diverting a portion of the stream of continuously flowing natural gas to a storage facility through a storage diversion line (22). The pressure of the natural gas is lowered, as is the temperature by the Joule-Thompson effect. The natural gas is passed in a single pass through a series of heat exchangers (18, 28,30, 32) prior to resuming flow through the gas line (12) at the lowered pressure. The diverted natural gas is liquefied in preparation for storage by effecting a heat exchange with the natural gas.

2 Claims, 3 Drawing Sheets

(56) References Cited

U.S. PATENT DOCUMENTS

| | | | | |
|---|---|---|---|---|
| 6,378,330 | B1 | 4/2002 | Minta | |
| 6,581,409 | B2 | 6/2003 | Wilding | |
| 6,751,985 | B2 | 6/2004 | Kimble | |
| 7,051,553 | B2 * | 5/2006 | Mak et al. | 62/636 |
| 2003/0182947 | A1 * | 10/2003 | Kimble et al. | 62/48.2 |

FOREIGN PATENT DOCUMENTS

| | | | |
|---|---|---|---|
| GB | 1 011 453 | A | 12/1965 |
| GB | 2 103 354 | A | 2/1983 |
| JP | 3-236589 | A | 10/1991 |
| RU | 2 180 420 | C2 | 3/2002 |

* cited by examiner

METHOD OF CONDITIONING NATURAL GAS IN PREPARATION FOR STORAGE

FIELD OF THE INVENTION

The present invention relates to a method of conditioning natural gas in preparation for storage.

BACKGROUND OF THE INVENTION

Natural gas is stored in storage facilities to meet peak and seasonal demands. These storage facilities typically are salt caverns and or old gas production wells. The geological formation of a salt cavern must have a minimum salt core thickness of 60 meters, thus these requirements in geological formation limits the location for natural gas storage facilities.

Processes for liquefying natural gas have been proposed, such as U.S. Pat. No. 6,751,985 (Kimble et al 2004) entitled "Process for producing a pressurized liquefied gas product by cooling and expansion of a gas stream in the supercritical state".

SUMMARY OF THE INVENTION

According to the present invention there is provided a method of conditioning natural gas in preparation for storage. A first step involves taking an existing stream of continuously flowing natural gas flowing through a gas line on its way to end users and diverting a portion of the stream of continuously flowing natural gas to a storage facility through a storage diversion line. A second step involves lowering the pressure of the stream of continuously flowing natural gas, thereby lowering a temperature of the continuously flowing natural gas by the Joules-Thompson effect. A third step involves passing the stream of continuously flowing natural gas in a single pass through at least one heat exchanger prior to resuming flow through the gas line at the lowered pressure. A fourth step involves liquefying diverted natural gas in the storage diversion line in preparation for storage and raising the temperature of the continuously flowing natural gas solely by effecting a heat exchange in the at least one heat exchanger between the continuously flowing natural gas in the gas line and the diverted natural gas in the storage diversion line.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
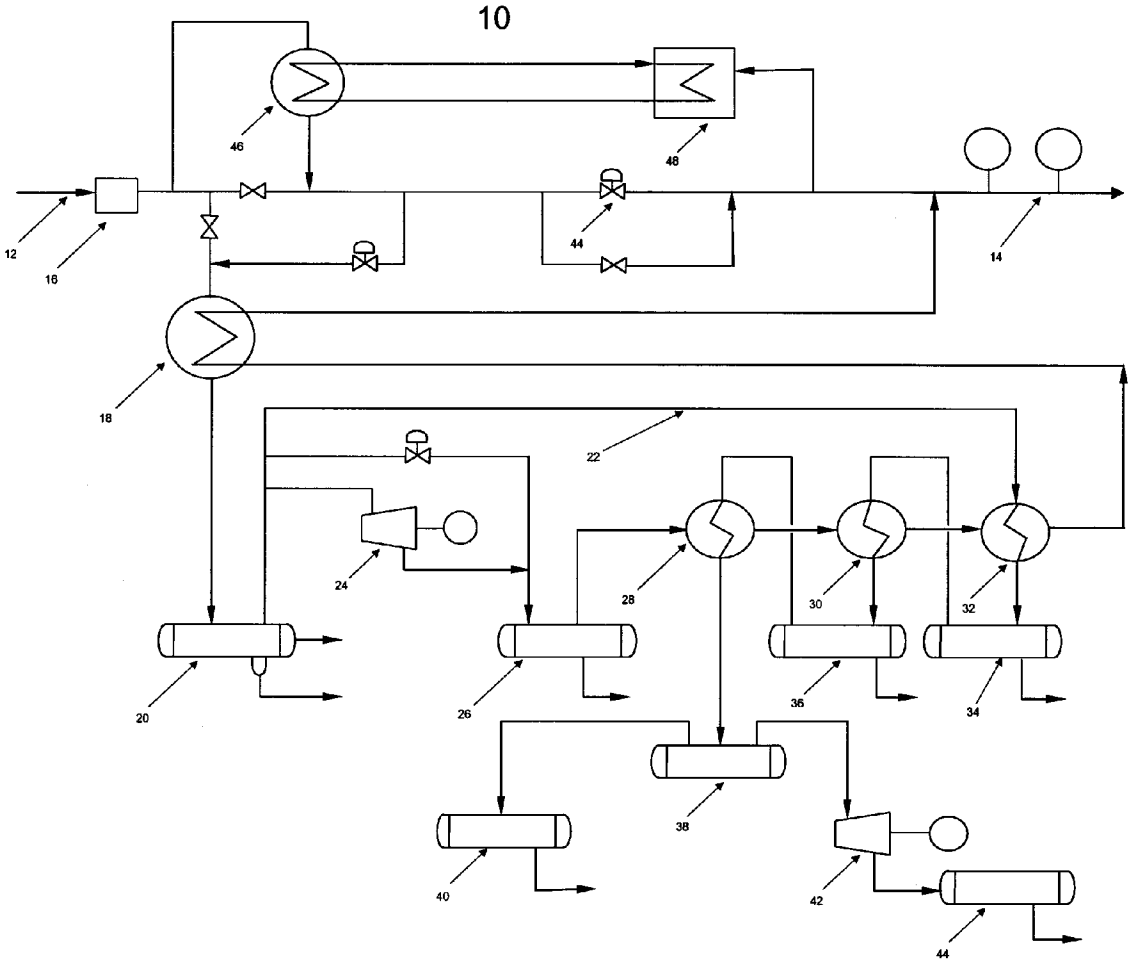
FIG. 1 is a flow diagram illustrating the preferred method of conditioning natural gas in preparation for storage in accordance with the teachings of the present invention.

The preferred method will now be described with reference to FIG. 1.

The proposed invention provides a process to store natural gas in-situ at every metering and pressure reduction station by utilizing the cold energy generated by the continuous flow of gas from natural gas mains to regional distribution pipelines and from regional distribution pipelines to end users. Presently this cold energy is wasted in two forms; first by preheating the gas prior to de-pressuring it into regional distribution systems (typically called city gates) to prevent the formation of hydrates, secondly by the choice of equipment used to de-pressure the natural gas. The conventional use of pressure letdown valves (JT valves) provide an isenthalphic (constant enthalpy, no work or heat transfer) expansion behavior resulting in a temperature drop of about 0.5 degrees Celsius for every 1 bar pressure drop, whereas the use of an expander (also known as a turbo expander) has an isentropic expansion behavior which results in a temperature drop of 1.5 to 2 degrees Celsius for every 1 bar pressure drop. Thus, the isentropic expansion allows for a lower temperature of the expanded gases at the same pressure reduction than that of isenthalphic expansion. This is significant since it provides 3 to 4 times more cold energy from the same source. By controlling the inlet gas temperature to the turbo expander, cryogenic temperatures are easily achieved since the critical temperature of methane is −82.5 C. This allows for small multiple storage systems of PLNG and LNG to be implemented either underground or above ground. PLNG and LNG storage facilities offer several advantages over alternative storage options, they can be located above ground or underground in comparison with traditional underground storage alternatives of high pressure gaseous natural gas that depend on underground geological conditions such as depleted reservoirs and salt caverns. This process provides an opportunity to meet gas peak flows, reducing annual upstream pipeline reservation charges associated with pipeline capacity. There are many other benefits associated with multiple storage sites (at selected pressure letdown stations), from energy savings for pipeline recompression and security of supply at point of use to gas market seasonal price opportunities and LNG distribution business opportunities. These LNG storage facilities located within the local utilities service area provide reliability to the local distribution system and operational flexibility during times of high demand. As well, it provides the opportunity to store natural gas as PLNG and LNG where geological conditions are not suitable for developing underground storage facilities. This process also provides the ability to produce LNG locally at very low cost, thus able to compete with the more expensive propane market. The storage of natural gas as PNG will apply at metering and pressure reduction stations where the "once through expander refrigeration cycle" cannot achieve the critical temperature of methane of −82.5 C which is required to liquefy methane.

The process uses the "once through expander refrigeration cycle", cold energy generated by the Joules-Thompson effect at metering and pressure reducing stations is recovered to liquefy and store natural gas as PLNG, LNG and PNG for future demand. This process offers three options for the storage of natural gas in the form of PLNG (pressurized liquefied natural gas), LNG (liquefied natural gas) and PNG (pressurized natural gas). The liquefication and storage of natural gas is preferably done through a slipstream supply line (the stream to storage) from the main header upstream of the turbo expander, thus maintaining the main pipeline head pressure. The refrigeration is provided by the continuous flow of gas that is first pre-treated and then depressurized on a "once through expander refrigeration cycle" where cryogenic temperatures are achieved, the true cryogenic temperature is dependent on pressure drop (1.5 to 2 C for every 1 bar pressure drop) and inlet temperature to the expander. At the outlet of the turbo expander a liquid KO drum is provided to recover any Natural Gas Liquids (NGL) present in the stream, the separated natural gas vapor flows into three heat exchangers arranged in series to exchange heat with a counter-current slipstream (the stream to storage) of high pressure natural gas (FIG. 1). The now warmed up, expanded gas stream flows into the gas distribution system. This is significant since it is the continuous flow of natural gas on the "once through expander refrigeration cycle" and into the gas distribution system that generates the cold energy used to liquefy the slipstream of natural gas storage into a LNG stream without the use of compression and pump refrigeration loops as traditionally used in refrigeration cycles.

The high pressure slipstream natural gas to storage has a KO (Knock Out) drum to recover the NGL generated at each heat exchanger. Upon leaving the last exchanger it is stored as PLNG at a desirable pressure for distribution. This PLNG storage method allows local distributors and utilities to store gas until needed and to easily meet peak demands. A side stream of PLNG can be further depressurized across another turbo expander to produce LNG at a 1 psig for local LNG markets.

The process heat exchanger arrangement downstream of the expander can be altered to fit specific local requirements yet maintaining the principle of reducing the volume of a gas to be stored. This is to say that the slipstream of gas to storage need not be liquefied where the critical temperature of methane (−82.5 C) is not achieved by the expander once through refrigeration cycle but simply reduced in volume for storage purposes utilizing the cold energy available. In case the production of LNG is desirable then a supplemental close loop refrigeration cycle can be added. A side benefit of this process is the generation of power by converting the energy of the gas stream into mechanical work as the gas expands through the expanders.

Referring to FIG. 1, at pressure letdown stations, generally indicated by reference number 10, gas typically is depressurized from a main supply line 12 with pressures up to 85 bar, to regional or local distribution lines 14 at pressures of 7 bar. Furthermore, the regional or local distribution lines 14 can further reduce the pressure to localized distribution lines (not shown) to pressures of 0.5 bar. In the example illustrated, natural gas enters the pressure letdown station 10 at high pressures and temperatures, typically above zero. It first passes through a meter 16, then a pre-cooling heat exchanger 18. Upon exiting heat exchanger 18, the natural gas then passes through a liquid knock out drum 20, where condensation in the form of H2O and impurities are removed. Knock out drum 20 operates on a float system. Liquids are released from knock out drum 20, when the liquid level rises to a preset level. The vapor stream then splits in two. A slipstream is diverted to storage through storage diversion line 22. The main flow of natural gas enters turbo expander 24 where the pressure is dropped and the temperatures are below minus 100 degrees C. This occurs because for every 1 bar pressure drop, the temperature drops 1.5 to 2 degrees C. From the outlet of turbo expander 24, natural gas enters a second knock out drum 26 where NGL (natural gas liquids), such as C5 pentane, C4 butane, C3 propane, C2 ethane, are separated. Knock out drum 26 also operates on a float system, such that a portion of the liquid is drained when the liquid reaches a preset level. The main vapor stream enters a second heat exchanger 28, where it exchanges its cold energy with a counter current warmer stream passing along the storage diversion line 22. Upon exiting heat exchanger 28, the temperature is increased. The main vapor stream then passes through another heat exchanger 30, where additional heat is gained. The main vapor stream then passes through another heat exchanger 32, where additional heat is gained. Finally, the main vapor stream passes through heat exchanger 18, exiting at a pressure of approximately 7 bar and a temperature above 0 degrees C. The main vapor stream now enters the regional pipeline distribution network 14.

The vapor slipstream of diverted gas passing along storage diversion line 22 after exiting knock out drum 20 at high pressure and temperature below 0 degrees C., flows to the heat exchanger 32 to preheat the main vapor stream. The diverted gas exits heat exchanger 32 and flows into knock out drum 34 to separate NGL from the vapor in the diverted gas. Knock out drum 34 operates on a float system, such that a portion of the liquid is drained when the liquid reaches a preset level. The vapor in the diverted gas exits knock out drum 34 and flows to heat exchanger 30 where it gives up its heat to the main gas vapor stream. The diverted gas exits heat exchanger 30 and flows into knock out drum 36 where any NGL present are separated. Knock out drum 36 also operates on a float system, such that a portion of the liquid is drained when the liquid reaches a preset level. The vapor in the diverted gas exits knock out drum 36 and flows into heat exchanger 28, where it gives up its heat to the main gas vapor stream. The diverted gas exists heat exchanger 28 and flows into knock out drum 38. The liquid fraction of knock out drum 38 is pumped into PLNG storage 40 to be supplied on demand. The vapor fraction from knock out drum 38 is expanded through turbo expander 42 to LNG storage 44 for supply on demand.

Variations:

Referring to FIG. 1, it may be preferable to maintain the existing pressure reduction station 44, including a heat exchanger 46 and a boiler 48, on standby in the event that it is needed for any reason.

Figure 2:
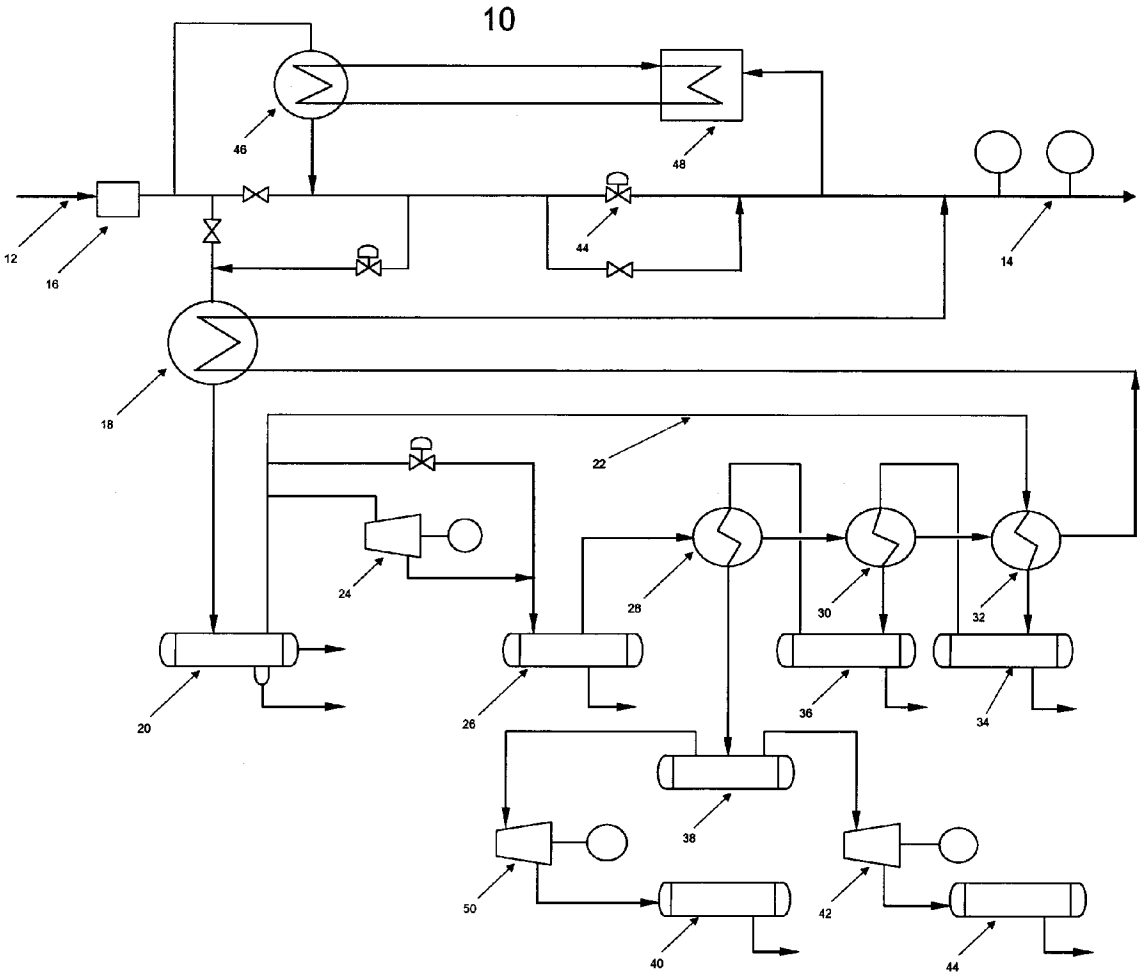
FIG. 2 is a flow diagram illustrating additional features which can be added to the preferred method of conditioning natural gas in preparation for storage illustrated in FIG. 1.

Referring to FIG. 2, an additional turbo expander 50 can be added to further reduce the pressure and cool the PLNG going to storage 40.

Figure 3:
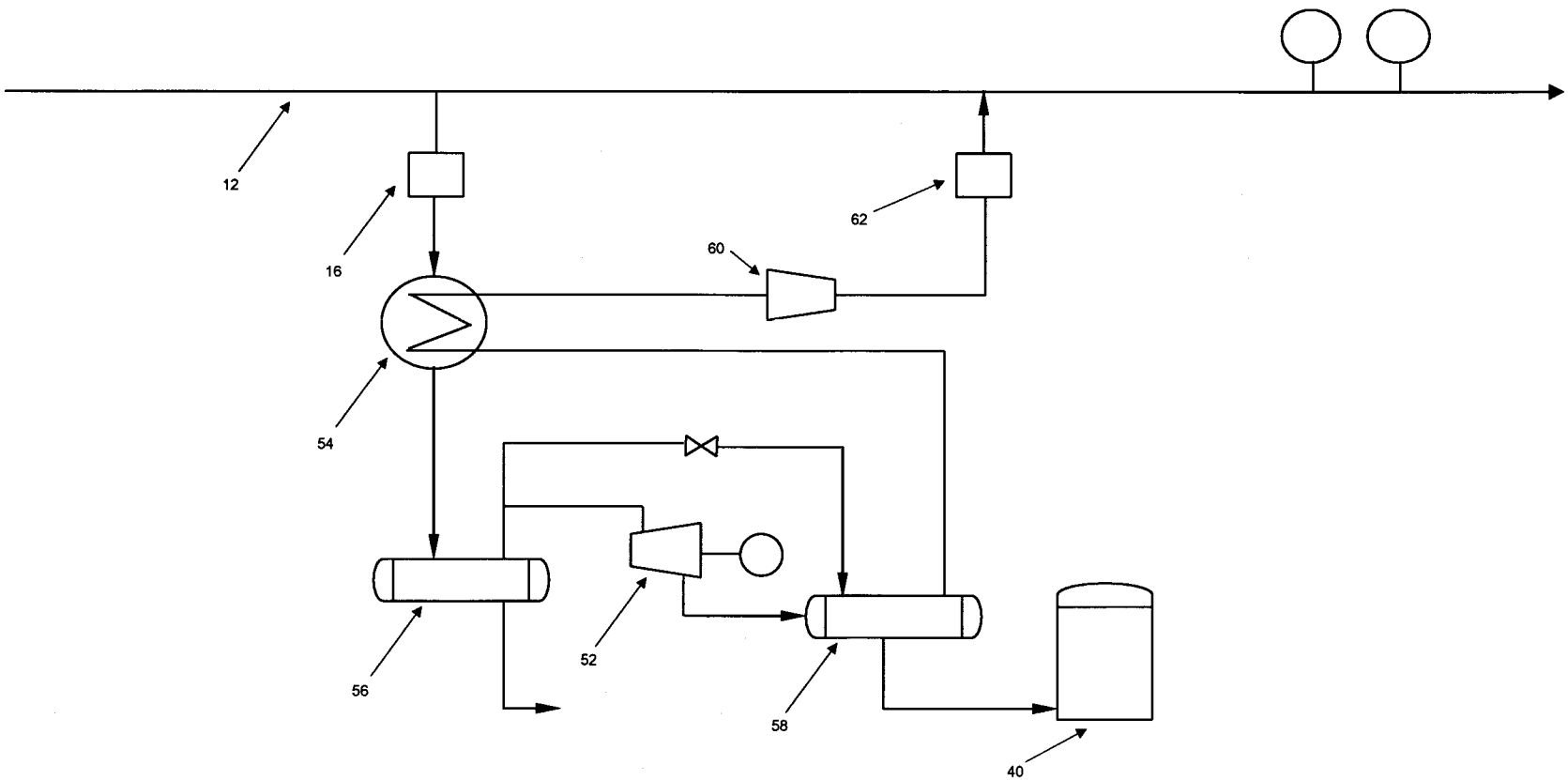
FIG. 3 is a flow diagram illustrating an alternative method of conditioning natural gas in preparation for storage, which can be used when the main gas line pressure is high enough to go directly through a turbo expander to storage.

Referring to FIG. 3, there has been illustrated how the diverted gas can be sent through a turbo expander 52 directly to storage 40 if the pressures in the gas line are sufficient. It can readily be calculated when this is possible, as there is a temperature drop of 1.5 to 2 degrees Celsius for every 1 bar pressure drop through the turbo expander 52. A quick calculation based upon the inlet gas pressure and temperature to the turbo expander 52, will determine whether temperatures colder than the critical temperature of methane (minus 82.5 degrees C.) can be achieved. It may not be necessary in all circumstances, but it is recommended that a portion of the diverted gas be recycled to heat exchanger 54 in order to effect a preliminary heat exchange with incoming gas so that condensation H2O can be knocked out at knock out drum 56 prior to passing diverted gas stream through turbo expander 52. The cooled gas separates in separator 58, the condensed liquid, LNG goes to storage 40 and the vapor goes through exchanger 54, recompressed by compressor 60 to meter 62 and to the gas transmission line 12.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

What is claimed is:

1. A method of conditioning natural gas in preparation for storage, comprising:

passing an existing stream of continuously flowing natural gas flowing through a high pressure gas line for processing at a pressure letdown station on its way to end users through a pre-cooling heat exchanger with a preliminary liquid knockout to remove condensation;

diverting a portion of the stream of continuously flowing natural gas through a storage diversion line;

lowering the pressure of the stream of continuously flowing natural gas at the pressure letdown station through the use of at least one turbo expander;

passing the stream of continuously flowing natural gas in a single pass through a series of heat exchangers to effect a staged heat exchange to increase the temperature of the continuously flowing natural gas, without further energy input, prior to exiting the pressure letdown station for distribution through distribution lines at the lowered pressure; and liquefying diverted natural gas in the storage diversion line in preparation for storage by effecting a staged heat exchange in the series of heat exchangers between the continuously flowing natural gas in the gas line and the diverted natural gas in the storage diversion line;

wherein the storage diversion line is arranged as a counter-current flow to the continuously flowing natural gas in the gas line through the series of heat exchangers;

wherein a liquid knockout exclusive to the continuously flowing natural gas is provided immediately downstream of the turbo expander to remove liquefied gases from the continuously flowing natural gas in the gas line; and wherein a liquid knockout exclusive to the storage diversion line is provided immediately downstream of each heat exchanger of the series of heat exchangers to remove liquefied gases heavier than methane from the diverted natural gas in the storage diversion line that fall out as the temperature of the natural gas is lowered.

2. The method as defined in claim 1, wherein at least one secondary turbo expander is placed on the storage diversion line downstream of the series of heat exchangers to further decrease the pressure and temperature of diverted natural gas.

* * * * *

UNITED STATES PATENT AND TRADEMARK OFFICE

CERTIFICATE OF CORRECTION

PATENT NO. : 8,555,671 B2
APPLICATION NO. : 12/162988
DATED : October 15, 2013
INVENTOR(S) : J. Lourenco et al.

It is certified that error appears in the above-identified patent and that said Letters Patent is hereby corrected as shown below:

On the Title Page

| | LINE | ERROR |
|---|---|---|
| Item (30) Pg. 1, col. 1 | Foreign Application Priority Data | "Jan. 20, 2006" should read --Jan. 31, 2006-- |

Signed and Sealed this
Eighth Day of April, 2014

Michelle K. Lee

Michelle K. Lee
*Deputy Director of the United States Patent and Trademark Office*